United States Patent [19]

Case

[11] Patent Number: 5,053,932

[45] Date of Patent: Oct. 1, 1991

[54] FLASHLIGHT RETAINER

[75] Inventor: Richard N. Case, Boulder, Colo.

[73] Assignee: RCP Enterprises, Inc., Boulder, Colo.

[21] Appl. No.: 530,005

[22] Filed: May 29, 1990

Related U.S. Application Data

[63] Continuation of Ser. No. 327,165, Mar. 22, 1989, abandoned.

[51] Int. Cl.[5] ..... F21L 15/14

[52] U.S. Cl. ..... 362/105; 362/190; 2/209.2

[58] Field of Search ..... 2/209.1, 209.2, 171, 2/185 R, 199, DIG. 11; 362/105, 106, 190, 191

[56] References Cited

U.S. PATENT DOCUMENTS

| | | | |
|---|---|---|---|
| 4,365,354 | 12/1982 | Sullivan | 2/DIG. 11 |
| 4,521,922 | 6/1986 | Mitchell et al. | 2/171 |
| 4,718,126 | 1/1988 | Slay | 362/105 |
| 4,797,793 | 1/1989 | Fields | 2/209.2 |
| 4,887,194 | 12/1989 | Fields | 2/209.2 |

*Primary Examiner*—Ira S. Lazarus
*Assistant Examiner*—Sue Hagerman
*Attorney, Agent, or Firm*—Donald W. Margolis

[57] ABSTRACT

The present invention provides a flashlight retainer that utilizes an elastic clip to accommodate flashlights of varying dimensional characteristics. In addition, the preferred embodiment of the flashlight retainer is primarily made of pliable materials so that it can be placed in a compact form when not in use.

14 Claims, 2 Drawing Sheets

FLASHLIGHT RETAINER

This is a continuation of application Ser. No. 07/327,165 filed Mar. 22, 1989, now abandoned.

FIELD OF THE INVENTION

The present invention relates to flashlight retainers.

BACKGROUND OF THE INVENTION

A flashlight retainer holds a flashlight adjacent to an object, such as a user's head, thereby allowing the user to accomplish a task without the encumbrance of having to hold the flashlight.

Exemplary of known flashlight retainers is U.S. Pat. No. 3,249,271 to Allbritton which discloses a flashlight holder for supporting a flashlight adjacent to a user's head. The flashlight holder includes a headband having a front strap, top strap and a rear strap that are preferably made of spring metal or plastic. The rear strap can be adjusted to conform the headband to the dimensions of the user's head. A clip assembly comprising a spacing strip, mounted to the headband by a rivet or weld, and a pair of arcuate spring strips, located at the ends of the spacing strip, cooperate to secure the flashlight to the holder. The invention of Allbritton, while freeing the user from having to hold the flashlight, has several disadvantages. For example, the use of spring metal or plastic to construct the headband and/or clip assembly prevents compact storage of the flashlight holder when not in use. Further, the closed-loop character of the front and rear straps prevents the headband from being positioned about an object that does not present a free or exposed end. Moreover, the arcuate spring strips only accommodate flashlights having a substantially circular, cross-sectional shape. Additionally, the arcuate spring strips are designed to accommodate a flashlight having a specific diameter. Further, the attachment of the clip assembly to the headband by a rivet or weld prevents manipulation of the position of the flashlight and, hence, the position of the beam.

Another known, flashlight retainer is illustrated in U.S. Pat. No. 4,360,930 to Blanchard. Blanchard provides an apparatus for connecting a flexible headband to a flashlight. The apparatus includes an attachment member that is made of a suitable metal or rigid polymeric material. The apparatus further includes a first device for pivotally coupling a first end of the headband to a first end of the attachment member and a second device for coupling a second end of the headband to a second end of the attachment member. Also included in the apparatus is a device for connecting the attachment member to a flashlight. In one embodiment of the apparatus a C-clamp is used to connect the attachment member to a flashlight having a substantially circular cross-section. In another embodiment of the apparatus a rivet and washer assembly are utilized to connect the attachment member to a flashlight. In yet another embodiment of the apparatus a band, clamped between two halves of a particular type of flashlight, serves to connect the attachment member to a flashlight. While the apparatus of Blanchard does serve to free the user thereof from having to hold the flashlight it also exhibits several disadvantages. For instance, the rigid nature of the attachment member and, in certain embodiments, the rigid character of the device for connecting the attachment member to the flashlight prevents compact storage of the apparatus when not in use. Moreover, the device for connecting the attachment apparatus to the flashlight is not adaptable to accommodate flashlights of varying dimensional characteristics. Consequently, the dimensional characteristics of the flashlight dictate the type of device employed to connect the flashlight to the attachment member. Furthermore, the connecting device employed in certain embodiments of the apparatus does not facilitate the attachment of a flashlight thereto. Conversely, such connecting devices also inhibit the detachment of a flashlight therefrom.

Yet another known, flashlight retainer is shown in U.S. Pat. No. 4,462,064 to Schweitzer. Schweitzer discloses a headlamp assembly that includes a closed-loop headband that is made of an elastic material to accommodate varying head sizes. Attached to the headband is a clip having an inner surface that defines a hollow portion suitable for accommodating a flashlight with rearwardly converging sidewalls. Further, in order to improve retention of the flashlight in the hollow portion, the inner surface of the clip is impregnated with grit particles. The clip further includes a wedge which provides a surface for adhesively bonding the clip to the headband. The wedge also serves to position the clip such that the light beam produced by the flashlight retained therein intersects the line of sight of the user. Moreover, the wedge acts to stiffen the remainder of the clip. While the headlamp assembly of Schweitzer does free the user from having to hold a flashlight it also has several disadvantages. For instance the closed-loop nature of the headband prevents attachment of the headlamp assembly to an object that does not present a free or exposed end. Further, the clip is only capable of accommodating a flashlight having particular dimensional characteristics. Moreover, the rigid nature of the wedge and, apparently, the remainder of the clip prevents compact storage of the headlamp assembly when not in use. Additionally, the rigid construction of the clip prevents manipulation of the position of the flashlight retained therein and, hence, the position of the beam.

In yet another reference, U.S. Pat. No. 4,718,126 to Slay discloses a flashlight holding headband apparatus which consists of a first strap of hook material and a second strap of elasticized loop material, the two straps being sewn together end to end to form a composite strap. The composite strap can be wrapped about a human head and formed into a band by use of the hood and loop material. A section of elastic material is sewn to the strap at its edges with the terminal ends of the elastic material then being sewn together on the opposite side of the band in order to prevent the terminal ends of the elastic material from unraveling. In the practice of the invention of Slay, materials such as thread or glue are needed to attach the elastic section to the headband, as well as to attach the terminal ends of the elastic section to one another. In order to produce the structure of the Slay invention, one would first be required to obtain a first strap totally of hood material, a second strap totally of loop material, and then sew one end of the hook material strap to one end of the loop material strap. Then, in order to construct an open ended sleeve for receiving a flashlight, one would have to first connect the ends of an elastic section to form a cylinder, then turn the cylinder inside out, slide the cylinder over the strap of loop material, then attach the cylinder of elastic material to both edges of the strap. In addition to requiring an excessive number of steps, the structure of Slay also requires the use of an amount of hook material as well an amount of loop material which required to connect the ends of the composite strap into a band. Furthermore, the structure of Slay, in order to connect the terminal ends of the elastic section, also requires the use of an excessive amount of elastic to form an open ended flashlight receiving sleeve. It is therefore seen that it would be useful and efficient, in terms of reducing both production steps and the use of expensive materials, to have a headband apparatus for retaining a flashlight which provided the same function as that of Slay, but which was composed of a single strap of material having only as much connecting material at its ends as is required to connect the ends of the strap to form a headband, as well as by providing an open ended sleeve which was terminated at the edges of the strap, instead of encircling the entire strap. Such a structure would reduce the number of steps necessary to produce the flashlight retaining device as well as the amount of hook material, loop material, and elastic material which is required to produce the device.

In yet another reference, U.S. Pat. No. 4,797,793 to Fields provides a single piece strap which serves to both form a band for engaging the head of the user, and also to create a pocket for receiving the barrel of a flashlight. The flashlight receiving pocket is formed by connecting two ends of the strap material in an overlapping area. Fields teaches how this connection is accomplished near the side edges of the strap material, in order to create a flashlight receiving close ended pocket between the interior and the exterior sides of the strap material. The disadvantage of the construction of Fields is that the depth of the pocket that may be formed between its overlapping edges is limited, so that the flashlights of an extended length cannot be accommodated by the structure. It is therefore seen, that it would be desirable to have a flashlight retaining headband, which includes an open ended sleeve for receiving a flashlight any length.

Based on the foregoing, and amongst other things, there exists a need for a flashlight retainer that is capable of accommodating flashlights of varying dimensional characteristics. Moreover, there is a need for a flashlight retainer that can be readily compacted when not in use. Further, there is a need for a flashlight retainer that facilitates attachment and detachment of the flashlight. Additionally, there is a need for a flashlight retainer that allows manipulation of the position of the flashlight retained therein, and the beam produced thereby. Furthermore, there is a need for a flashlight retainer that can be positioned on an object that does not present a free or exposed end. Moreover, there exists a need for a flashlight retainer that can be adjusted for attachment to objects having different dimensional characteristics.

SUMMARY OF THE INVENTION

The present invention provides an apparatus for attaching a flashlight to an object. The apparatus includes a device for engaging the object. In one embodiment, the device for engaging includes a strap having a first end and a second end that are joined about the object by a fastener. The strap can be positioned about objects that present exposed ends and objects that do not present exposed ends. The apparatus further includes a device, operatively connected to the device for engaging, for use in holding the flashlight. The device for use in holding the flashlight is made of an elastic material that allows flashlights of varying dimensional characteristics to be accommodated.

In another embodiment of the invention the device for use in holding the flashlight, which is directly connected to the means for engaging, is made of a pliable material that can be compacted when not in use. Preferably, the device for engaging the object in this embodiment includes a strap and a fastener that are also made of pliable materials that can be readily compacted when the device is not in use.

In the preferred embodiment of the invention the apparatus includes a strap made of a pliable, non-elastic material. The apparatus further includes a fastener for joining the ends of &he strap about the object. The fastener comprises a length of hook material and a length of loop material. The length of hook material is located on one side of, and substantially adjacent to one end of, the strap. Similarly, the length of loop material is located on the other side of, and substantially adjacent to the other end of, the strap. In operation the length of hook material is brought into overlapping engagement with the length of loop material to join the ends of the strap into a band about the object. The lengths of hook and loop material also allow the strap to be formed into bands of different circumference so that objects having different dimensional characteristics can be accommodated. The preferred embodiment of the apparatus further includes a sleeve made of an elastic material and having two side edges and two end edges. The two side edges of the sleeve are attached adjacent to the side edges of the strap to form a longitudinally extending space, extending between the two end edges, for receiving the flashlight. The use of the elastic material allows flashlights of varying dimensional characteristics to be accommodated.

DETAILED DESCRIPTION OF THE PREFERRED EMBODIMENT

Figure 2:
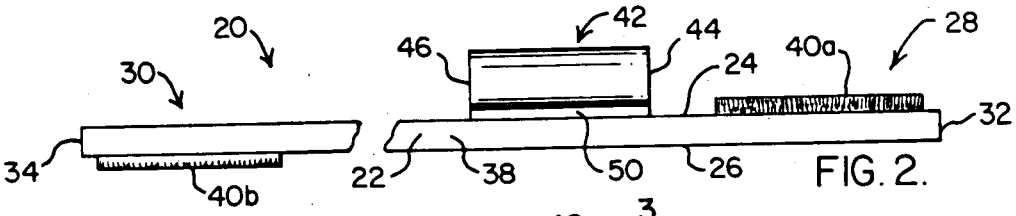
FIG. 2 is a side view of the preferred embodiment of the invention.
Figure 1:
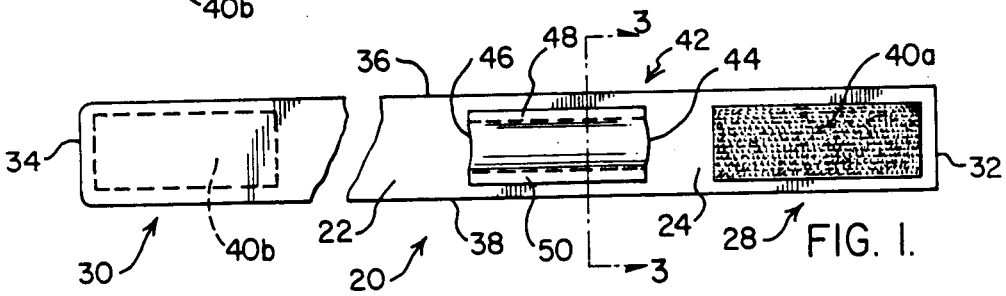
FIG. 1 is a top view of the preferred embodiment of the invention.

With reference to FIGS. 1–5, the preferred embodiment of the flashlight retainer 20, hereinafter referred to as retainer 20, is illustrated. The retainer 20 includes a strap 22 for positioning about an object. Advantageously, the strap 22 can be positioned about an object that presents an exposed end, such as the head of a user, or an object that does not present an exposed end, like a post or rail with both ends embedded in concrete or the like. The strap 22 has an exterior side 24, an interior side 26, a first end 28, a second end 30, a first end edge 32, a second end edge 34, a first side edge 36 and a second side edge 38. The strap 22 can be made in a variety of lengths and widths to accommodate different applications. For instance, if the strap 22 is to be positioned about a human head it is made approximately twenty-six inches in length and approximately one inch in width. Preferably, the strap 22 is made of a pliable material that increases the ability of the retainer 20 to be placed in a compact form when not in use. Suitable materials include natural fabrics, such as cotton and wool. Preferably, however, the strap 22 is made of a synthetic material, such as nylon or polypropylene. The strap 22 is also, preferably, made of a non-elastic material.

The retainer 20 further includes a fastener for joining the first end 28 and the second end 30 of the strap 22 into a band or loop about an object. Preferably, the fastener is comprised of a first fastening portion 40*a* and a second fastening portion 40*b*. The first fastening portion 40*a* is located substantially adjacent to the first end 28 of the strap 22 and the second fastening portion 40*b* is located substantially adjacent to the second end 30 of the strap 22. In operation the first fastening portion 40*a* is brought into engagement with the second fastening portion 40*b* to join the first end 28 and the second end 30 of the strap 22 about an object. Preferably, the first and second fastening portions 40*a*, 40*b*, are made of pliable materials, such as hook-and-loop materials, that increase the ability of the retainer 20 to be placed in a compact form when not in use. In the preferred embodiment of the retainer 20 the first fastening portion 40*a* is a length of hook material located substantially adjacent to the first end 28, and on the exterior side 24, of the strap 22. The second fastening portion 40*b*, in the preferred embodiment, is a length of loop material located substantially adjacent to the second end 30, and on the interior side 26, of the strap 22. In operation the hook material of the first fastening portion 40*a* is brought into overlapping engagement with the loop material of the second fastening portion 40*b* to form the strap 22 into a band or loop about an object. The fastener also, preferably, allows the circumference of the band to be adjusted so that the retainer 20 can be attached to objects having different circumferences. Such a fastener also allows the tension of the band about a given object to be adjusted. In the preferred embodiment of the retainer 20, adjustment of the circumference of the band and/or the tension in the band is accomplished by using appropriate lengths of hook and loop material to realize the first and second fastening portions 40*a*, 40*b*.

The retainer 20 further includes a clip 42 for use in holding a flashlight. The preferred embodiment of the clip 42 includes a third end edge 44, a fourth end edge 46, a third side edge 48 and a fourth side edge 50. The third side edge 48 and the fourth side edge 50 of the clip 42 are attached substantially adjacent to, respectively, the first side edge 36 and the second side edge 38 of the strap 22, such that an inner surface 52 of the clip 42 and a portion of the exterior side 24 of the strap 22 form a longitudinally extending opening 54 for receiving a flashlight. Various orientations of the space for receiving the flashlight can be achieved by changing the attachment of the sleeve 42 to the strap 22. For instance, the sleeve 42 can be attached to the strap such that a transversely extending space for receiving the flashlight is defined. The length of the clip 42, i.e., the distance separating the third end edge 44 and the fourth end edge 46, is chosen such that the flashlight received in the longitudinally extending space 54 is supported in a stable fashion. The clip 42 is made of pliable material that increases the ability of the retainer 20 to be placed in a compact form when not in use. Preferably, the sleeve 42 is also made of an elastic material that allows the longitudinally extending opening to expand and/or contract to accommodate flashlights of varying dimensional characteristics. Making the sleeve 42 from an elastic material also allows, to a degree, the flashlight contained in the longitudinally extending space 54 to be rotated such that a beam produced by the flashlight can be vertically positioned. Suitable elastic material include natural elastic materials, like rubber, as well as synthetic elastic materials.

Figure 6:
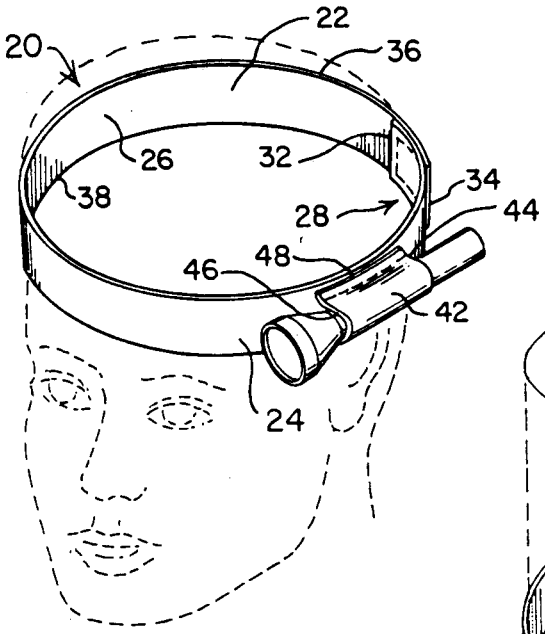
FIG. 6 illustrates the preferred embodiment of the invention positioned on the head of a user and with a flashlight attached thereto.
Figure 3:
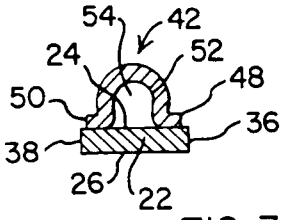
FIG. 3 is an cross-sectional view of the preferred embodiment of the invention.
Figure 7:
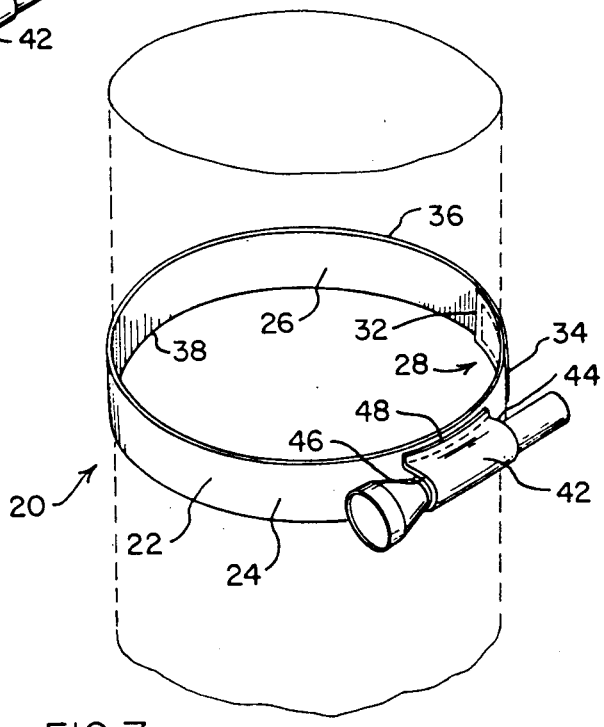
FIG. 7 illustrates the preferred embodiment of the invention positioned about a post and with a flashlight attached thereto.
Figure 5:
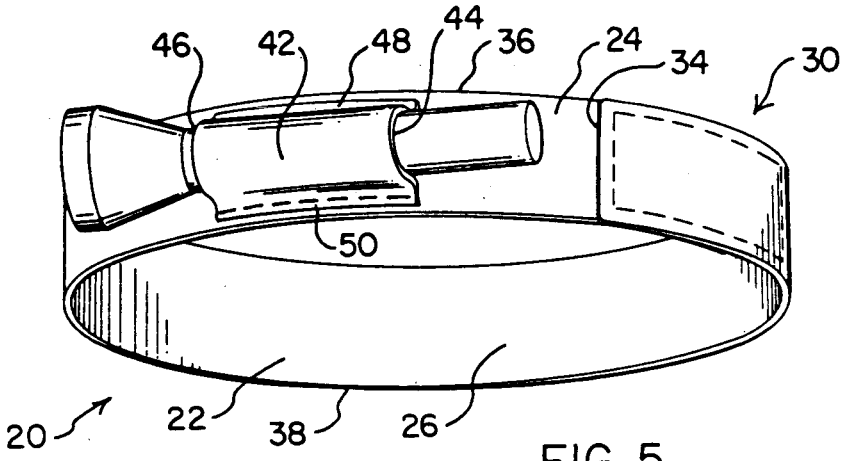
FIG. 5 illustrates a flashlight attached to the preferred embodiment of the invention.
Figure 4:
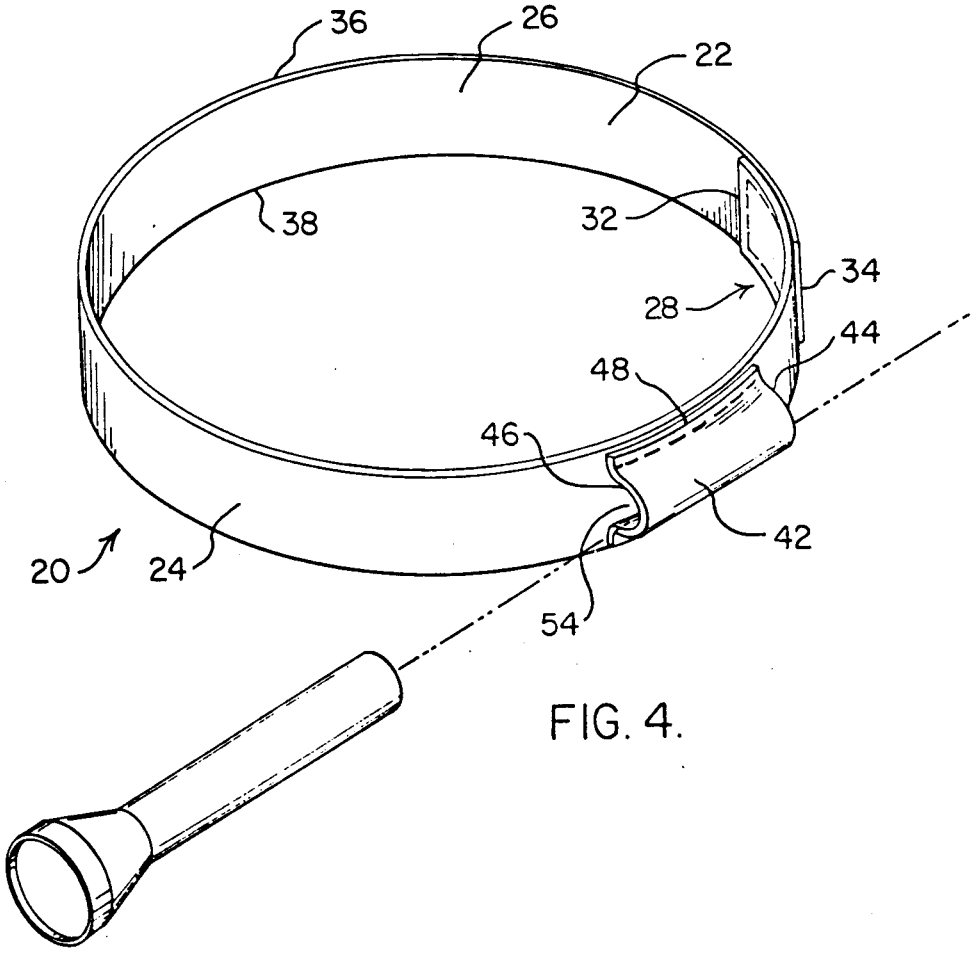
FIG. 4 illustrates the preferred embodiment of the invention with a flashlight detached therefrom.

With reference to FIGS. 5–6, operation of the retainer 20 involves engaging the strap 22 about an object by positioning the interior side 26 of the strap 22 adjacent to the object and using the first and second fastening portions 40*a*, 40*b*, to form the strap 22 into a band or loop, with the desired tension, about the object. A flashlight is positioned in the longitudinally extending opening 54 defined by a portion of the exterior side 24 of the strap 22 and the inner surface 52 of the clip 22. In the preferred embodiment of the retainer 20 the clip 42 is made of an elastic material that allows the longitudinally extending space 54 to accommodate the dimensional characteristics of the flashlight. The inner surface 52 of the sleeve 42 and the portion of the exterior side 24 of the strap 22 that together define the longitudinally extending space 54 also cooperate to frictionally hold the flashlight in place. The pliable materials used to realize the strap 22, the first and second fastening portions 40*a*, 40*b*, and the sleeve 42 also allow the retainer 20 to be placed in a compact form when not in use.

As will be apparent to those skilled in the art, a number of variations of the described embodiment of the invention are possible. For example, the need for a fastener could be eliminated by employing a substantially non-elastic band having a fixed circumference. Such a band, however, would not be capable of being positioned about object that did not present an exposed end. Moreover, such a band would only accommodate objects having the fixed circumference. To accommodate objects having varying circumference the band could be made of an elastic material. However, the use of an elastic material, whether for a band or a strap, would sacrifice some of the tension control provided by the preferred embodiment of the invention. Furthermore, fasteners other than hook-and-loop type fasteners could be employed. In addition, a pliable fastener that only attaches to one end of the strap is feasible. For instance, a series of loops made of a pliable and flexible material could be attached to one end of the strap. The other end of the strap could then be inserted through the loops one or more times to achieve a frictional engagement. Additionally, the use of hook material and loop materials for, respectively, the first and second fastening portions 40*a*, 40*b*, could be reversed. Moreover, the first and second fastening portions 40*a*, 40*b*, could be located on, respectively, the interior side 26 and the exterior side 28 of the strap 22. In addition, the clip 42 could be made from two or more pieces of material spaced from one another along the strap 22.

As used herein, the term "single," when applied to the strap, carries its dictionary meaning of not being accompanied by another (strap), consisting of a one part (strap), and not as a multiple (strap).

The foregoing description of the invention has been presented for purposes of illustration and description. Further, the description is not intended to limit the invention to the form disclosed therein. Consequently, variations and modifications commensurate with the above teachings, and the skill or knowledge in the relevant art are within the scope of the present invention. The preferred embodiment described hereinabove is further intended to explain the best mode known of practicing the invention and to enable others skilled in the art to utilize the invention in various embodiments and with the various modifications required by their particular applications or uses of the invention. It is intended that the appended claims be construed to include alternative embodiments to the extent permitted by the prior art.

What is claimed is:

1. An apparatus for holding a flashlight and also capable of being formed into a variably sized headband loop, comprising:

a single non-elastic strap having a first longitudinal end and a second longitudinal end, a first side edge and a second side edge, said single non-elastic, strap also having a first surface and a second surface;

loop-type material secured to said first surface of said single non-elastic strap, said loop-type material being substantially adjacent to said first longitudinal end on said first surface of said single non-elastic strap;

hook-type material secured to said second surface of said single non-elastic strap, said hook-type material being substantially adjacent to said second longitudinal end on said second surface of said single non-elastic strap, said hook-type material being designed and positioned to be removably attachable to a portion of said loop-type material for form a variably sized headband loop; and a second of elastic material, said section of elastic material having an inner surface, a first side edge and a second side edge, said first side edge and said second side edge of said section of elastic material each being separately affixed to one of said surfaces of said strap in a manner such that a substantially cylindrical sleeve which is open at both ends is defined by a portion of said inner surface of said section of elastic material and said surface of said strap to which said section of elastic material is affixed, said substantially cylindrical sleeve having a longitudinal axis which is substantially aligned with said single non-elastic strap, said section of elastic material being expandable to a size which is suitable to receive the body of a flashlight through both of said open ends of said substantially cylindrical sleeve, said elastic material being located intermediate said first and said second ends of said strap and also being intermediate said loop-type material and said hook-type material.

2. The flashlight holding apparatus of claim 1 wherein said loop-type material is sewed to said first surface of said single non-elastic band and said hook-type material is sewed to said second surface of said single non-elastic band.

3. The flashlight holding apparatus of claim 1 wherein said section of elastic material is secured to said first surface of said single non-elastic band with said first side edge and said second side edge of said elastic material being connected, respectively, only to said first side edge and said second side edge of said single non-elastic strap.

4. The flashlight holding apparatus of claim 1 wherein said loop-type material is sewed to said first surface of said single non-elastic band and said hook-type material is sewed to said second surface of said single non-elastic band, and wherein further, said section of elastic material is secured to said first surface of said single non-elastic band as said loop-type material, with said first side edge and said second side edge of said elastic material being sewed, respectively, only to said first side edge and said second side edge of said single non-elastic strap.

5. An apparatus for holding a flashlight and also capable of being formed into a variably sized band loop, comprising:

a single non-elastic strap having a first longitudinal end and a second longitudinal end, a first side edge and a second side edge, said single non-elastic strap also having a first surface and a second surface;

first connecting means substantially adjacent to one of said longitudinal ends of said single non-elastic strap;

second connecting means substantially adjacent to the other longitudinal end of said single non-elastic strap, said second connecting means being designed and positioned to be removably attachable to a portion of said first connecting means to form a variably sized band loop; and a second of elastic material, said section of elastic material having an inner surface, a first side edge and a second side edge, said first side edge and said second side edge of said section of elastic material each being separately affixed to one of said surfaces of said strap in a manner such that a substantially cylindrical sleeve which is open at both ends is defined by a portion of said inner surface of said section of elastic material and said surface of said strap to which said section of elastic material is affixed, said substantially cylindrical sleeve having a longitudinal axis which is substantially aligned with said single non-elastic strap, said section of elastic material being expandable to a size which is suitable to receive the body of a substantially cylindrical flashlight through both of said open ends of said substantially cylindrical sleeve, said elastic material being located intermediate said first and said second ends of said strap and also being intermediate said first and second connecting means.

6. The flashlight holding apparatus of claim 5 wherein said first connecting means is loop-type material secured to one of said surfaces of said strap and said second connecting means is hook-type material secured to the other of said surfaces of said strap, said hook-type material being designed and positioned to be removably attachable to a portion of said loop-type material to form a headband.

7. The flashlight holding apparatus of claim 5 wherein said hook-type material is sewed to one said surface of said single non-elastic band.

8. The flashlight holding apparatus of claim 5 wherein said loop-type material is sewed to one said surface of said single non-elastic band.

9. The flashlight holding apparatus of claim 5 wherein said hook-type material is sewed to one said surface of said single non-elastic band and said loop-type material is sewed to the other said surface of said single non-elastic band.

10. The flashlight holding apparatus of claim 9 wherein said section of elastic material is secured to the same surface of said single non-elastic band as said loop-type material.

11. The flashlight hold apparatus of claim 6 wherein said second of elastic material is secured to the same surface of said single non-elastic band as said loop-type material.

12. The flashlight holding apparatus of claim 5 wherein said first side edge and said second side edge of said elastic material is connected, respectively, only to said first side edge and said second side edge of said single non-elastic strap.

13. The flashlight holding apparatus of claim 12 wherein said first side edge and said second side edge of said elastic material are connected only to the same surface of said single non-elastic strap.

14. The flashlight holding apparatus of claim 5 wherein said length of elastic material is smaller than the length of a flashlight.

* * * * *